US011974706B1

(12) United States Patent
Figueroa

(10) Patent No.: US 11,974,706 B1
(45) Date of Patent: May 7, 2024

(54) WASHCLOTH WITH BUILT-IN SCRUBBING ELEMENT

(71) Applicant: Michael Louis Figueroa, Redding, CA (US)

(72) Inventor: Michael Louis Figueroa, Redding, CA (US)

( * ) Notice: Subject to any disclaimer, the term of this patent is extended or adjusted under 35 U.S.C. 154(b) by 613 days.

(21) Appl. No.: 16/677,313

(22) Filed: Nov. 7, 2019

Related U.S. Application Data

(60) Provisional application No. 62/917,566, filed on Dec. 17, 2018.

(51) Int. Cl.
*A47K 7/02* (2006.01)

(52) U.S. Cl.
CPC ..... *A47K 7/022* (2013.01)

(58) Field of Classification Search
CPC ..... A47K 7/022; A47K 7/02; A47L 13/10; A47L 13/16
USPC ..... 15/222, 118, 209.1, 210.1; 601/118
See application file for complete search history.

(56) References Cited

U.S. PATENT DOCUMENTS

| | | | | |
|---|---|---|---|---|
| 1,990,568 | A * | 2/1935 | Scheidler | A47K 7/022 601/143 |
| 4,234,994 | A * | 11/1980 | Schwab | A47K 7/022 15/222 |
| 5,545,456 | A | 8/1996 | Suida | |
| 5,787,541 | A | 8/1998 | Chen | |
| 6,499,901 | B1 | 12/2002 | Rabbani | |
| 10,244,902 | B1 | 4/2019 | Wagner | |
| 10,507,160 | B1 * | 12/2019 | Losole | B65B 5/022 |
| 2008/0263801 | A1 | 10/2008 | Morris | |
| 2010/0087762 | A1 * | 4/2010 | Herbert | A61H 39/04 601/134 |
| 2013/0098381 | A1 | 4/2013 | McBrayer | |

* cited by examiner

*Primary Examiner* — Thomas Raymond Rodgers
(74) *Attorney, Agent, or Firm* — John P. Costello

(57) ABSTRACT

A washcloth is comprised of a first washcloth layer and a second washcloth layer, wherein the first and second washcloth layers at least partially overlap each other. A compressible scrubber is placed between the overlapping portion of the layers, and the layers are joined together, forming a pocket to contain the scrubber between the layers, but also allowing the scrubber a degree of movement therebetween. The scrubber is preferably of a spherical shape having a compressible quality so that it adopts an oval shape upon being compressed. Examples of a scrubber in accordance with the invention are a rubber ball or a spherical hollow plastic lattice.

3 Claims, 6 Drawing Sheets

WASHCLOTH WITH BUILT-IN SCRUBBING ELEMENT

CROSS-REFERENCE TO RELATED APPLICATIONS

This application claims the benefit of U.S. Provisional Patent Application No. 62/917,566, filed on Dec. 17, 2018.

BACKGROUND OF THE DISCLOSURE

Technical Field of the Disclosure

This invention relates to washcloths and, more specifically, relates to an improved washcloth which incorporates a scrubbing element for achieving superior purchase of the washcloth against a surface being scrubbed.

Description of the Related Art

The common washcloth is an effective tool for cleaning most parts of the body in its unmodified form. However, this ubiquitous cleaning tool is nearly ineffective when a bather attempts to scrub the back of the torso, starting along the spine and proceeding laterally outward. It is this area where bathers have commonly substituted other tools, such as the long-handled back brush, to complete the chore of cleaning the body. Many devices are present in the prior art which attempt to use a washcloth, or washcloth-like device to wash the back.

U.S. Pat. No. 10,244,902, issued to Wagner, is an attempt to combine a back brush with a washcloth. A washcloth is attached to an elongate shaft, the combination offering a user the means by which to reach the otherwise unreachable areas of the back. A drawback to this device is that a secondary adapting tool (the elongate shaft) must always be on hand to combine with the washcloth, in order to achieve the desired back-cleaning result.

U.S. Patent Application Publication No. 2008/0263801 issued to Morris, is an exfoliating and cleansing washcloth having lanyards attached at opposite diagonal corners of the washcloth. The user can grasp a lanyard in each hand and move the washcloth back and forth, across the back, until an appropriate level of cleaning is achieved. The exfoliating area is spread out across the washcloth of this device and no way to pinpoint specific areas of the back for special attention can be achieved.

Other cleaning systems operate on the concept of inserting a bar of soap in a washcloth having a void, or multiple pockets and having lanyards for looping the bather's fingers. These systems achieve both soaping and scrubbing simultaneously. Exemplary of these types of systems are found in U.S. Patent Application Publication No. 2013/0098381 by McBrayer and U.S. Pat. No. 6,499,901 to Rabbani. Typically, with this device, the bar of soap is flat-sided or eventually wears down to become a flat-sided remnant of its initial shape which can become brittle and break. Such flat-sided shapes do not operate well in pinpointing specific areas of the back as the downward force applied on the lanyards is spread out across the flat side of the soap, across a larger area, which may include the specific area, but fails to pinpoint it.

Other washcloth designs insert a plurality of solid massage balls in between layers of net-like fabric to provide a massaging effect. These devices are also reliant on lanyards positioned at opposite ends of the device to move it back and forth across the user's back. Exemplary references in this regard include U.S. Pat. No. 5,787,541, issued to Chen, and U.S. Pat. No. 5,545,456 issued to Suida. Once again, this device spreads force among the flat sided soap and multiple solid balls. Additionally, solid balls do not compress, and instead just roll along the back, no matter how much pressure is applied by the user. Such a rolling action may be good for massaging, but less effective for applying a pinpoint scrubbing action.

Thus, there is a need for a washcloth design which allows the user to pinpoint specific areas, especially those areas on the back of the torso. Additionally, there is a need for a washcloth design that can exert increased pressure for high friction scrubbing at the pinpointed areas.

SUMMARY OF THE DISCLOSURE

The invention described herein is directed toward an improved washcloth which allows the user to scrub specific areas of the body. The invention has special utility in cleansing the back of the torso and allowing the user to pinpoint areas of the back for high friction scrubbing.

In one embodiment the inventive washcloth is comprised of a first washcloth layer and a second washcloth layer, wherein the first and second washcloth layers at least partially overlap each other. A compressible scrubber is placed between the overlapping portion of the layers, and the layers are joined together, trapping the scrubber in between the layers, but also allowing the scrubber a degree of movement to adopt an oval shape when downward force is applied on the scrubber. The scrubber is preferably a spherical shape having a compressible quality so that it adopts an oval shape upon being compressed. Examples of a scrubber in accordance with the invention are a rubber ball or a spherical hollow lattice wherein the beams of the lattice are made of flexible material.

In another embodiment of the invention, the washcloth layers are each approximately square with the overlapping layers joined together in the same diagonal orientation so that at least two corners of a first washcloth layer align in a diagonal line with at least two corners of a second washcloth layer. The two diagonally aligned layers provide a significant diagonal span such that a user can grasp the device easily at the two outermost corners of the washcloth when applying the device across the back of the torso.

In a further embodiment, the scrubber that is located between the overlapping layers is compressible to a desired degree. It has been found that when the scrubber compresses a certain amount under pressure applied from the user at the outermost corners of the washcloth, that the scrubber preferably adopts an oval shape, which places scrubbing pressure upon a location desired by the user, allowing effective cleaning at the pinpointed area.

In another embodiment, the scrubber is placed off-center between the outermost diagonal corners of the washcloth device. When the device is inverted, the lower part of the back can be reached with the off-center-positioned scrubber. This design significantly increases the surface area of the back that can be washed and areas which can be pinpointed.

It is a first object of the invention to provide a washcloth which can scrub the back of the torso, effectively, thus negating the necessity to use back brushes.

It is another object of the invention to provide a washcloth which can more effectively place scrubbing pressure upon desired areas of the body.

It is a further object of the invention to provide a washcloth having a scrubber which can be used to both scrub and massage areas of the body, such as the bottom of the feet.

These and other advantages and features of the present invention are described with specificity so as to make the present invention understandable to one of ordinary skill in the art.

BRIEF DESCRIPITON OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized, and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

As used herein, the singular forms "a", "an" and "the" include plural referents unless the context clearly dictates otherwise. "And" as used herein is interchangeably used with "or" unless expressly stated otherwise. As used herein, the term 'about" means +/−5% of the recited parameter. All embodiments of any aspect of the invention can be used in combination, unless the context clearly dictates otherwise.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "wherein", "whereas", "above," and "below" and words of similar import, when used in this application, shall refer to this application as a whole and not to any particular portions of the application.

The description of embodiments of the disclosure is not intended to be exhaustive or to limit the disclosure to the precise form disclosed. While the specific embodiments of, and examples for, the disclosure are described herein for illustrative purposes, various equivalent modifications are possible within the scope of the disclosure, as those skilled in the relevant art will recognize.

Figure 1:
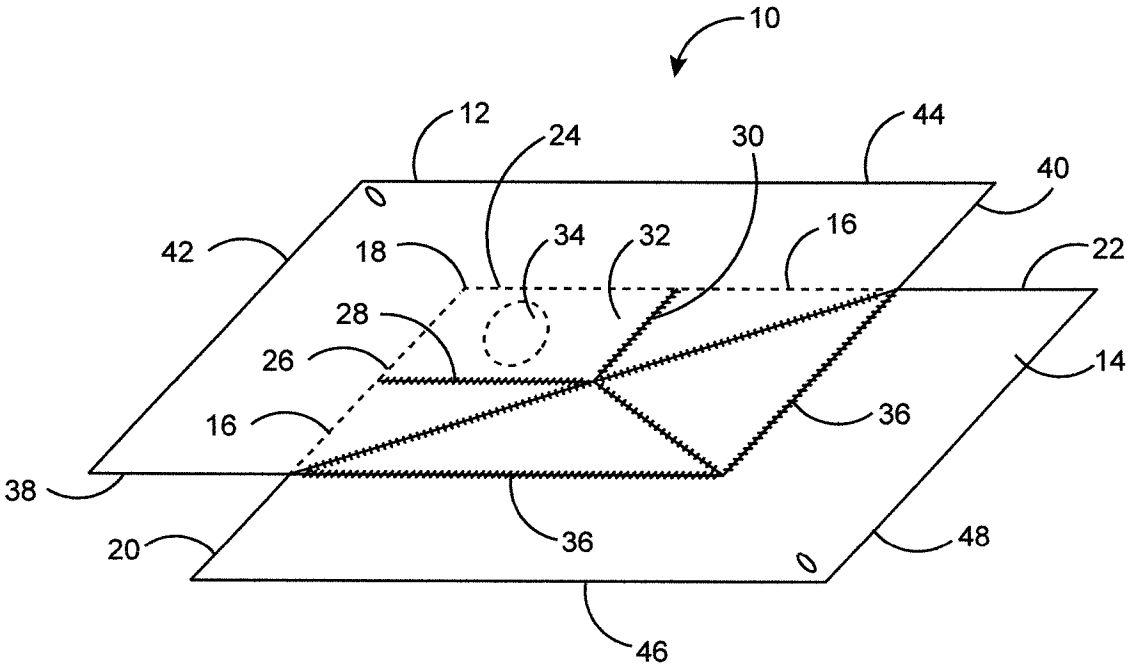
FIG. 1 is an elevated perspective view of the washcloth in accordance with the invention.

FIG. 1 is an elevated perspective view of the inventive washcloth 10 showing an upper layer 12 overlapping a lower layer 14. Dotted lines 16 show portions of first 20 and second 22 sides of the lower layer 14 extending beneath the upper layer 12 and joining at corner 18. The portions 16 of first 20 and second 22 sides of lower layer are coupled to the first upper layer by stitching. A pocket 32 is defined by first side 24, second side 26, third side 28 and fourth side 30, the top of pocket 32 being comprised of a portion of the upper layer 12 and the floor of pocket 32 being a portion of the lower layer 14. Residing in the pocket 32 is a scrubber 34 which is held between the four sides of pocket 32, yet preferably a modicum of space remains to allow scrubber to move slightly in the pocket 32.

The overlapping area 50 (See also FIG. 2) of upper layer 12 and lower layer 14 is defined by portions 16 of first and second sides 20, 22 of lower layer and portions 36 of third 38 and fourth 40 sides of upper layer. First 42 and second 44 sides of upper layer 12 as well as third 46 and fourth 48 sides of lower layer remain entirely outside the boundary of the overlapping area 50. Pocket 32 occupies a portion of the overlapping area 50, defined by first side 24, second side 26, third side 28 and fourth side 30 (See FIG. 1).

Figure 2:
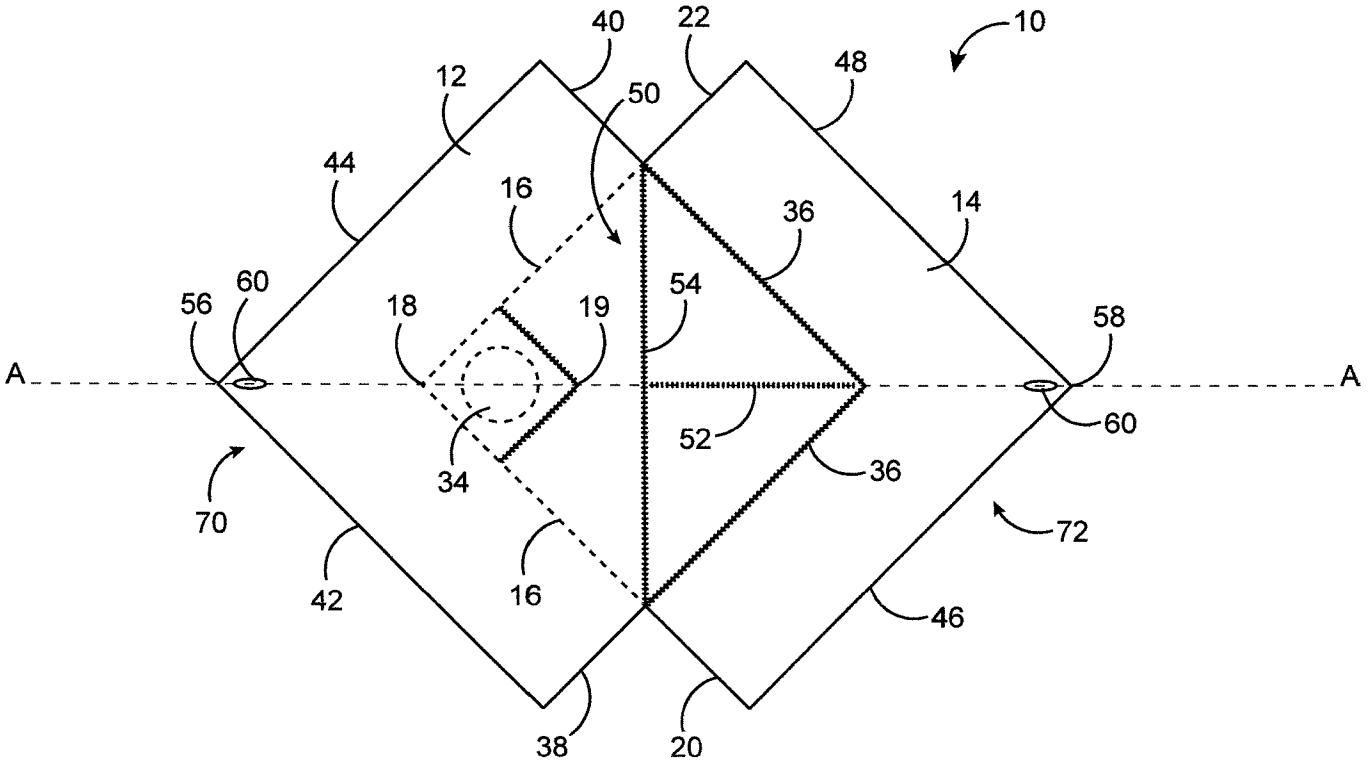
FIG. 2 is a plan view of the of the washcloth in accordance with the invention.

FIG. 2 represents a plan view of the washcloth 10 introduced in FIG. 1. Portions 16 of first and second sides of lower layer (dotted lines) and portions 36 of third and fourth sides of upper layer are stitched so that upper layer 12 joins to lower layer 14. First 52 and second 54 reinforcing stitches also join the upper and lower layers together at the overlapping area 50 to adequately bear pulling forces generated by the user at outermost diagonal corners 56, 58. Outermost diagonal corners 56, 58 each have a reinforced through-hole 60 through which a user can thrust his index fingers and extend the washcloth 10 behind the back of the user's torso. By steadily pulling the washcloth 10 back and forth across the back, the user can scrub the back clean and focus the scrubber upon specific areas of the back.

Figure 3:
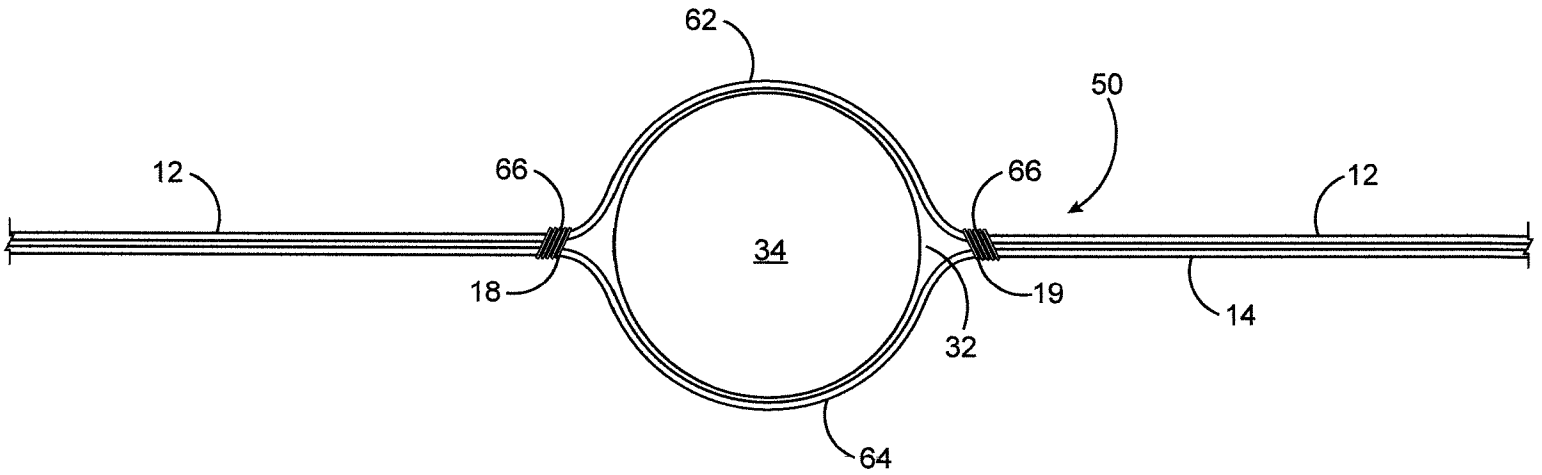
FIG. 3 is a cutaway view of a section of the inventive washcloth taken through line A-A of FIG. 2 and focusing upon the scrubber and pocket in which it resides.

FIG. 3 represents a side cutaway view of a section of the washcloth 10 comprised primarily of the overlapping area 50 and taken through line A-A of FIG. 2. Upper layer 12 and lower layer 14 are shown joined together to form the pocket 32 in which scrubber 34 resides. The overlapping area 50 extends beyond pocket 32, pocket extending between corners 18 and 19 which are obscured by corner stitches 66. This view also shows that the roof 62 of pocket 32 is comprised of upper layer 12 and the floor 64 of pocket 32 is comprised of lower layer 14. In this view, the scrubber 34 is a slightly compressible rubber ball of between 1.75-2.0 inches in diameter. The upper and lower layers would be preferably comprised of washcloth material such as terry cloth, microfiber, or a combination thereof, wherein each layer is approximately 12×12 inches square.

Figure 4A:
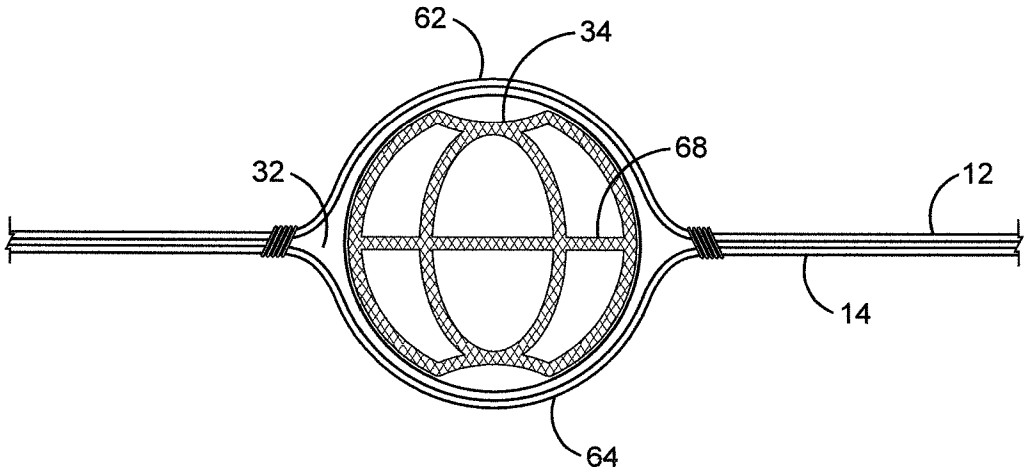
FIG. 4A is a cutaway view of a section of the inventive washcloth focusing upon the scrubber and pocket in which it resides, this embodiment showing the scrubber as a spherical lattice.
Figure 4B:
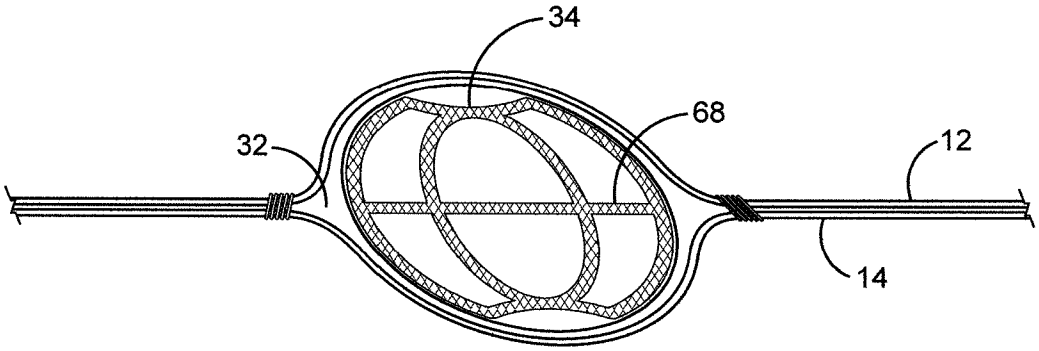
FIG. 4B is a cutaway view of the embodiment of FIG. 4A showing the scrubber being subjected to downward forces and adopting a compressed, somewhat oval shape.

FIG. 4A represents a side cutaway view of a section of the washcloth 10 containing the pocket 32 with an alternative scrubber 34 residing therein, this view also taken through line A-A of FIG. 2. The scrubber 34 in this view is a hollow plastic spherical lattice 68. The beams of the lattice flex when force is applied. This spherical lattice scrubber has a tendency to adopt an oval shape when downward force is imparted to the washcloth as will be further discussed herein. FIG. 4B demonstrates scrubber 34 adopting an oval shape in the pocket 32 due to downward force being applied. This adoption of an oval shape creates a greater surface area between the scrubber and the skin of the back.

Referring again to FIG. 2, the offset positioning of the scrubber 34 between the outermost diagonal corners 56, 58 defines a superior end 70 and an inferior end 72 of the washcloth 10. Superior end 70 is closest to scrubber 34 and is the end by which the user can impart a greater level of downward force upon scrubber in an "x" direction of an imaginary axis, against a surface being scrubbed, when the through-holes 60 are being used. The inferior end 72 allows the user to retract the washcloth 10 while a back and forth action is being exercised upon the washcloth 10, and providing force in a "y" direction, but less in the "x" direction than that which could be exerted on the superior end 72.

Figure 5:
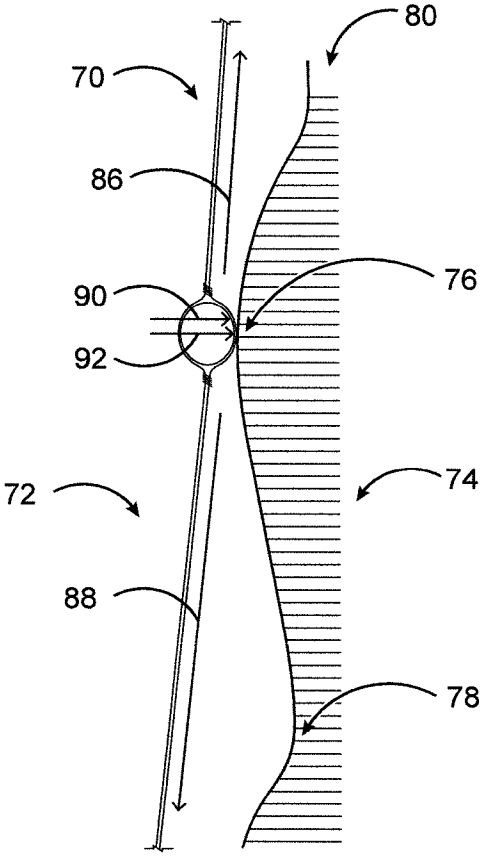
FIG. 5 is a sideview of the back of a human torso from the lower back up to the neck area, showing the washcloth being applied to the back in a cleansing application and also showing the various forces at play when applying the washcloth.

FIG. 5 represents the washcloth 10 of the present invention being used to scrub the back 74 of a user's torso and shows the various forces at play. In this view, the user's upper back 76 is being targeted for cleaning, but any desired area of the back could likewise apply these principals for targeted scrubbing. The upper back 76, lower back 78 and head and neck area 80 shown are all potential areas for cleaning. If, for example, instead of targeting the upper back 76 as shown, the user could swap the superior end 70 with the inferior end 72, opposite as shown here, and target the lower back 78.

The various force vectors in FIG. 5 are labeled as follows: 1) F1X represents a pulling force approximating a "x" direction of an x-y axis at the superior end 70 and represented by arrow 86; 2) F2X represents the pulling force approximating a "x" direction of an x-y axis at the inferior end 72, this force being in the opposite direction to that of F1X and represented by arrow 88; 3) F1Y represents a downward force against the upper back 76 imparted by the user when moving the washcloth 10 in the F1X direction from the superior end 70, this downward force being applied primarily in a "y" direction against the upper back 76 and represented by arrow 90; and 4) F2Y represent a downward force against the upper back 76 imparted by the user when moving the washcloth 10 in the F2X direction from the inferior end 72 against the upper back 76 and represented by arrow 92. The offset location of scrubber 34 between inferior 72 and superior 70 ends ensures that F1Y is always a greater downward force than F2Y, allowing the user to selectively allocate force between F1Y and F2Y. As the back and forth motion is maintained as represented by F1X and F2X, the user can apply downward force allocated between F1Y and F2Y to achieve a desired level of cleansing at a pinpointed location on the user's back.

The foregoing description of the embodiments of the present invention has been presented for the purpose of illustration and description. It is not intended to be exhaustive or to limit the invention to the precise form disclosed. Many modifications and variations are possible in light of the above teachings. It is intended that the scope of the present invention is not limited by this detailed description, but by the claims and the equivalents to the claims appended hereto.

The invention claimed is:

1. A washcloth comprising:

a square-shaped upper layer having an upper axis extending diagonally across two corners and a center of the square upper layer;

a square-shaped lower layer having a lower axis extending diagonally across two corners and a center of the square lower layer, wherein the upper layer sewn to and covers the lower layer, the upper and lower layers being aligned along the upper and lower axis and the center of the square upper layer and the center of the square lower layer are offset along said aligned axis such that the diagonally aligned layers have an outermost corner of the upper layer aligned with an outermost corner of the lower layer;

wherein the outermost corners reside in one layer of material; the covering of the upper layer upon the lower layer forming an approximately square overlapping area;

a pocket formed in the overlapping area wherein the upper layer forms a roof of the pocket and the lower layer forms the floor of the pocket, the pocket comprising a portion of the approximately square overlapping area;

a spherical scrubber residing in the pocket formed in the overlapping area, the scrubber being compressible when subjected to a downward force against a surface being washed; the scrubber residing in the pocket being located between a superior end and an inferior end of the washcloth, the superior end terminating in a first outermost corner of the washcloth and the inferior end terminating in a second outermost corner of the washcloth, the first outermost corner aligning with the second outermost corner along a diagonal line;

a first through-hole being sized to fit a human finger imparted in the first outermost corner of the superior end;

a second through-hole being sized to fit a second human finger imparted in the second outermost corner of the inferior end; and wherein the scrubber residing in the pocket is positioned nearest to the first outermost corner of the superior end of the washcloth.

2. The washcloth as recited in claim 1, wherein the scrubber is a spherical lattice, the scrubber adopting an oval shape when subjected to the downward force being applied to the scrubber.

3. The washcloth as recited in claim 2, wherein the spherical lattice is further comprised of a plastic material.

* * * * *